US006845817B2

(12) United States Patent
Schraub

(10) Patent No.: US 6,845,817 B2
(45) Date of Patent: Jan. 25, 2005

(54) KICK OVER TOOL FOR SIDE POCKET MANDREL

(75) Inventor: John Schraub, Huntsville, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 31 days.

(21) Appl. No.: 10/259,803

(22) Filed: Sep. 27, 2002

(65) Prior Publication Data

US 2004/0060694 A1 Apr. 1, 2004

(51) Int. Cl.[7] ..... E21B 23/03; E21B 17/00

(52) U.S. Cl. ..... 166/242.5; 166/117.5; 166/162; 166/381

(58) Field of Search ..... 166/381, 372, 166/162, 242.1, 242.5, 117.5

(56) References Cited

U.S. PATENT DOCUMENTS

| | | | | | |
|---|---|---|---|---|---|
| 3,561,528 | A | * | 2/1971 | Butler et al. | 166/117.5 |
| 3,561,535 | A | * | 2/1971 | Butler et al. | 166/381 |
| 3,732,928 | A | * | 5/1973 | Sizer | 166/383 |
| 3,752,231 | A | * | 8/1973 | McGowen et al. | 166/117.5 |
| 3,876,001 | A | * | 4/1975 | Goode | 166/117.5 |
| 4,026,363 | A | * | 5/1977 | Yonker et al. | 166/381 |
| 4,031,954 | A | * | 6/1977 | Herbert et al. | 166/117.5 |
| 4,051,895 | A | * | 10/1977 | Embree | 166/117.5 |
| 4,294,313 | A | * | 10/1981 | Schwegman | 166/117.5 |
| 4,368,780 | A | * | 1/1983 | Merritt | 166/117.5 |
| 4,375,237 | A | * | 3/1983 | Churchman | 166/117.5 |
| 4,452,305 | A | * | 6/1984 | Schwendemann | 166/117.5 |
| 4,765,403 | A | * | 8/1988 | Crawford et al. | 166/117.5 |
| 4,976,314 | A | * | 12/1990 | Crawford et al. | 166/117.5 |
| 5,425,425 | A | * | 6/1995 | Bankston et al. | 166/377 |
| 6,422,312 | B1 | * | 7/2002 | Delatorre et al. | 166/250.15 |

FOREIGN PATENT DOCUMENTS

| | | |
|---|---|---|
| GB | 1 515 248 | 6/1978 |
| GB | 2 103 683 | 2/1983 |
| GB | 2 103 685 | 2/1983 |

OTHER PUBLICATIONS

GB Search Report, Application No. GB 0322638.8, dated Dec. 5, 2003.

* cited by examiner

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

An apparatus for use in manipulating an eccentrically located well bore device. One embodiment of the apparatus comprises: a main body attachable to a conveyance member; an arm hinged to the main body; a lock assembly for selectively retaining the arm in a locked position and releasing the arm from the locked position; a kick over assembly for moving the arm to kicked over position; and an adapter connected to the lift arm, the adapter connectable with a tool for latching onto the device. The kick over assembly comprises a kick member operatively connected to the arm and a biasing member having a first end connected to the arm and a second end connected to the kick member.

22 Claims, 10 Drawing Sheets

KICK OVER TOOL FOR SIDE POCKET MANDREL

BACKGROUND OF THE INVENTION

1. Field of the Invention

Embodiments of the present invention generally relate to an apparatus for manipulating an eccentrically located well bore device. More particularly, embodiments of the present invention relate to a kick over tool for installing devices into and removing devices from a side pocket mandrel, particularly mandrels located in deviated wells.

2. Description of the Related Art

When the natural flow of liquid from a well has ceased or becomes too slow for economical production, artificial production methods are employed. In many cases, it is advantageous, at least during the first part of the artificial production period, to employ gas lift. Numerous types of equipment for producing liquid by gas lift are available, but they all rely upon the same general principles of operation. In the usual case, dry gas consisting essentially of methane and ethane is forced down the pressure string and into the liquid in the production string. As the liquid in the production string becomes mixed with gas, the density of the liquid decreases, and eventually the head pressure of the column of the gasified liquid in the production string becomes less than the pressure exerted on the body of liquid (flowing bottom hole pressure) in the well, and the flow of liquid occurs at the surface.

One gas lift technique, known as continuous gas lift, injects gas into the pressure string which has been sealed or packed off at the bottom of the hole relative to the production tubing. Gas lift valves are placed in the production string for unloading and producing. The operating gas lift valve permits the gas to be injected into the liquid being produced. This gas then makes the liquid in the production tube lighter and, hence, the flowing bottom hole pressure will be sufficient to push the liquid up and out of the well. Thus, the well is produced at a greater rate.

A further adaptation of this gas lift technique is known as intermittent gas lift. In this technique, rather than letting the gas enter the production tube continuously, the gas is injected into the production tubing intermittently, under a producing slug of fluid. The gas bubble then drives the slug of liquid in the production tubing upwardly. The technique is repeated successively, thereby producing successive slugs of liquid at the wellhead.

The primary means for placing the high pressure gas from the pressure string into the production conduit is via a gas lift valve located in a side pocket mandrel, with the mandrel being part of the production conduit. FIG. 1 illustrates an oil production well 10 having a side pocket mandrel 20 as part of the production conduit 30. The side pocket mandrel is designed with a pocket, or receiver, within the mandrel. The side pocket is offset from the centerline of the tubing. Most side pocket type retrievable valve mandrels have a full-bore internal diameter equal to the tubing internal diameter. A gas lift valve can be removed or installed by simple wire line operations, as is understood by those of ordinary skill in the art. The use of wire line eliminates the need to pull the entire production conduit from the well bore when an operator determines that it is necessary to change out valves. The primary wire line device for locating the mandrel pocket and selectively removing or installing devices such as a gas lift valve is a kick over tool.

Many wells drilled today are highly deviated. Highly deviated wells that produce sand and have a high formation gas/liquid ratio are excellent candidates for gas lift when artificial lift is needed. While these highly deviated wells result in some reservoir drainage efficiencies, other problems may result. One problem relates to the installing and retrieving of devices such as gas lift valves. FIG. 2 is a cross sectional view of a prior art kick over tool 40 utilized for installing and removing devices from a side pocket mandrel. The kick over tool 40 is activated by pulling a dog 42 on the tool up against a shoulder 44 in the mandrel 46 to release the kick over arm 48 that carries the flow control device 50. The arm 48 is biased outwardly so that its outward movement aligns the bottom nose of the device 50 with the side pocket 52 of the mandrel 46. Downward movement and jarring are then used to insert the flow control device 50 into the side pocket 52 and to release the arm 48 from the latch 54 attached to the device 50. However, the bow springs or leaf springs 56 utilized to bias the arm 48 outward may not be strong enough, or may become too weak over time, and fail to position the tip of the device 50 at the side pocket 52 of the mandrel 46, particularly when the mandrel 46 is located in a deviated well with the side pocket 52 at an upper position. The device 50 is then unable to be inserted into the side pocket 52.

Therefore, there is a need for a kick over tool which provides reliable service in installing devices into and removing devices from a side pocket mandrel, and more particularly, from a side pocket mandrel located in a deviated well.

SUMMARY OF THE INVENTION

The present invention generally provides a reliable kick over tool for installing devices into and removing devices from a side pocket mandrel, and more particularly, from a side pocket mandrel located in a deviated well.

One embodiment provides an apparatus for manipulating an eccentrically located well bore device. The apparatus comprises: a main body attachable to a conveyance member; an arm hinged to the main body; a lock assembly for selectively retaining the arm in a locked position and releasing the arm from the locked position; a kick over assembly for moving the arm to a kicked over position; and an adapter connected to the lift arm, the adapter connectable with a tool for latching onto the device. The kick over assembly comprises a kick member operatively connected to the arm and a biasing member having a first end connected to the arm and a second end connected to the kick member.

In another embodiment, a kick over assembly for a lift arm of a kick over tool is provided. The kick over assembly comprises a kick member pivotally connectable to the lift arm and a biasing member having a first end connectable to the lift arm and a second end connected to the kick member.

Another embodiment provides a kick over tool comprising: a main body comprising a fishing head; an arm hinged to the main body; a locking mechanism disposed on the main body for locking the arm in a first position and releasing the arm to a kicked over position; a kick member for moving the arm to the kicked over position; a biasing member having a first end connected to the arm and a second end connected to the kick member; and an adapter connected to the arm for latching onto a down hole device.

Yet another embodiment provides an apparatus for manipulating an eccentrically located well bore device, comprising: a main body attachable to a conveyance member, the main body comprising a kick over assembly; and a catcher barrel connected to the main body.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention generally provides a reliable kick over tool for installing devices into and removing devices from a side pocket mandrel, and more particularly, from a side pocket mandrel located in a deviated well. One embodiment provides an apparatus for manipulating an eccentrically located well bore device. The kick over tool may be utilized to install and retrieve down hole devices, particularly, valves such as gas lift valves, water flood valves, and steam injection valves which are positioned in a side pocket mandrel.

Figure 1:
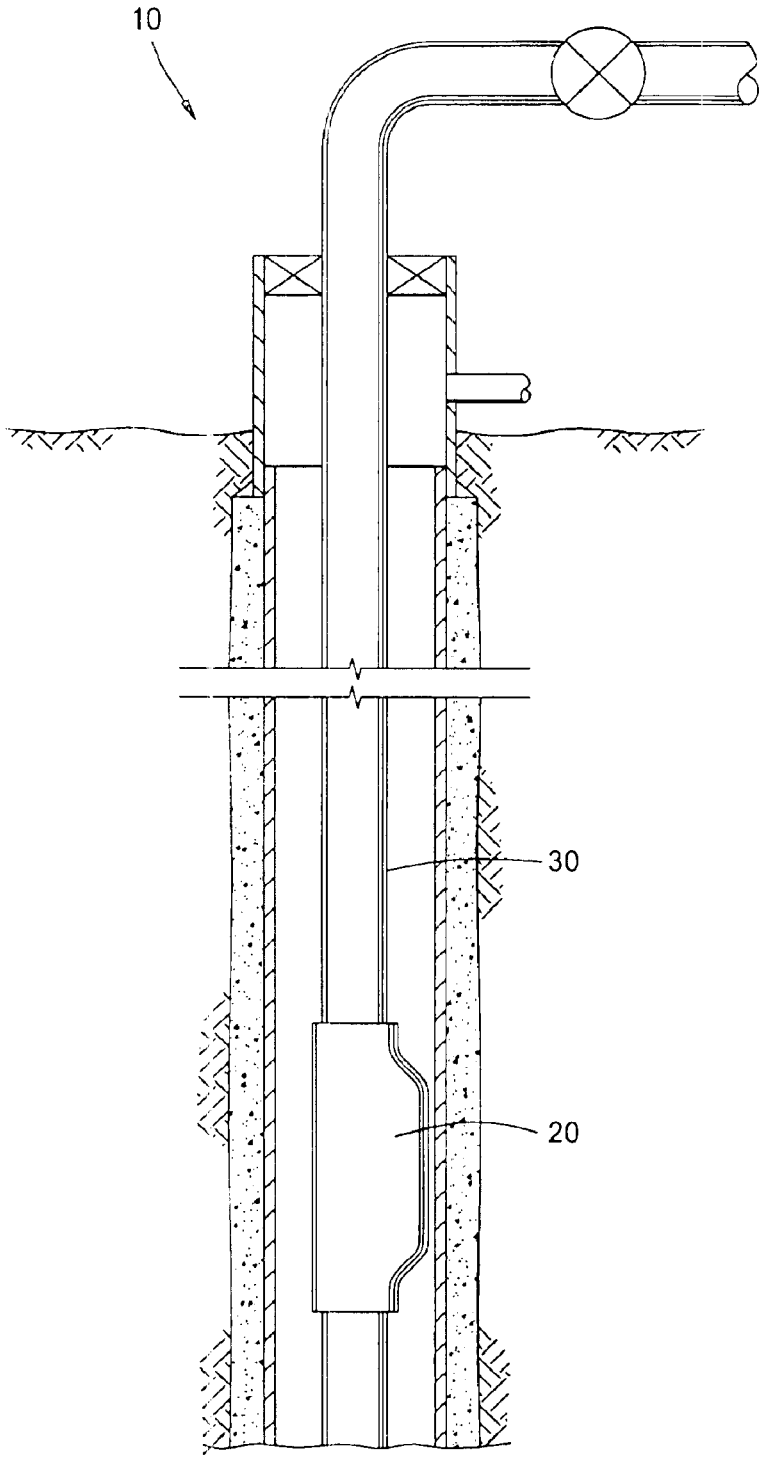
FIG. 1 (PRIOR ART)
FIG. 1 is a sectional view of a prior art oil production well.
Figure 2A:
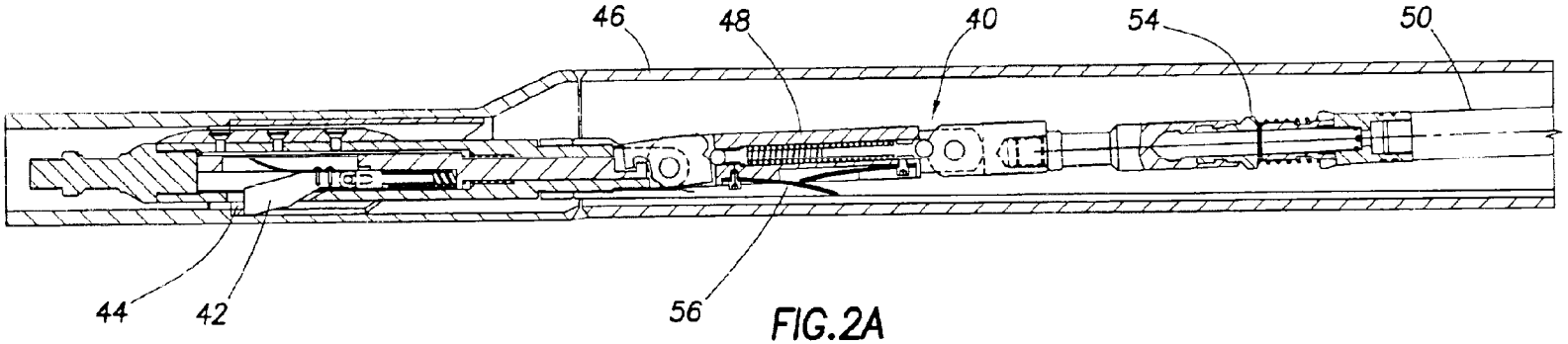
FIG.2A (PRIOR ART)
FIG. 2 is a sectional view of a prior art kick over tool.
Figure 2B:
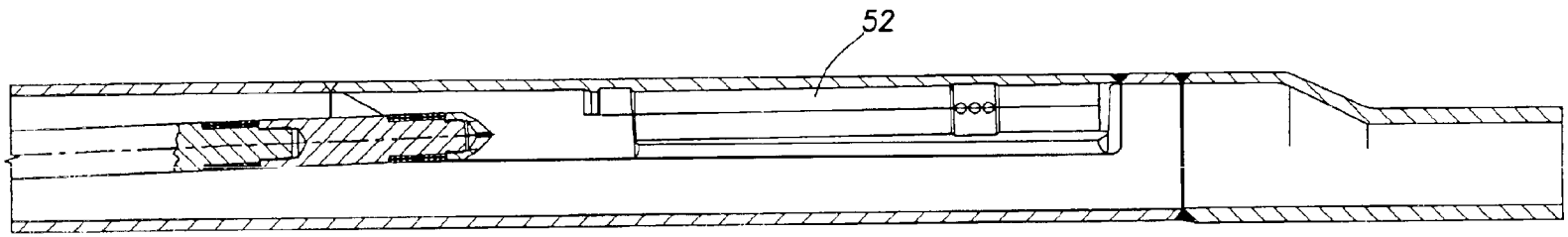
FIG.2B (PRIOR ART)
Figures 3A, 3B:
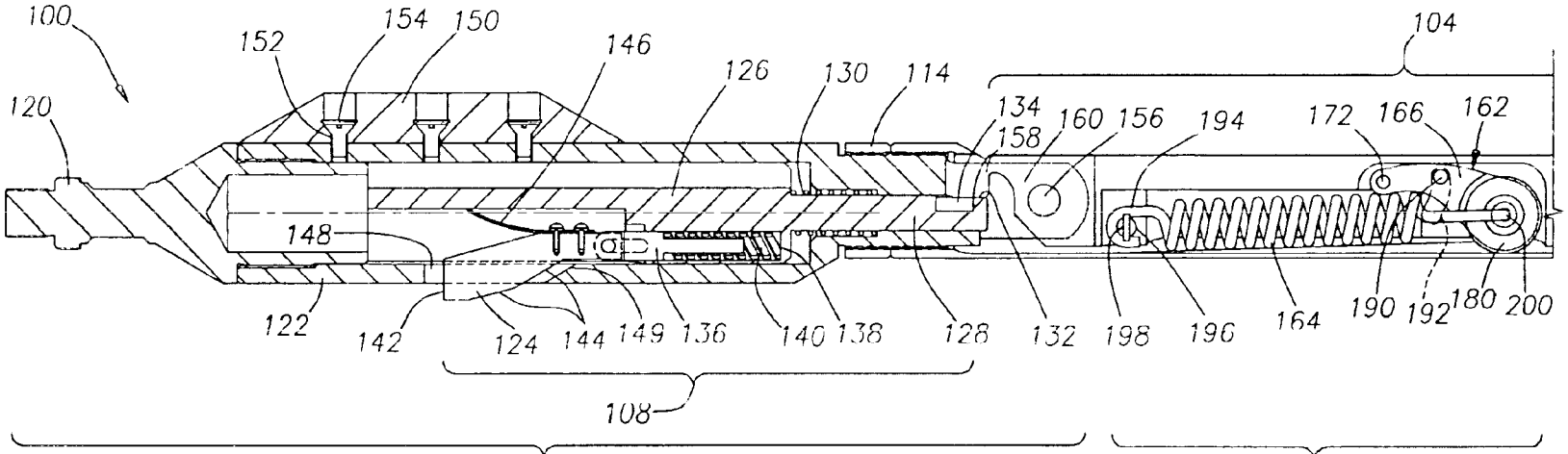
FIG. 3 is a sectional view of one embodiment of a kick over tool according to the invention.

FIG. 3 is a sectional view of one embodiment of a kick over tool according to the invention. The kick over tool 100 generally includes a main body 102, a lift arm 104, and an adapter 106. The main body 102 is connected to conveyance member (e.g., a wire line) which controls the position of the kick over tool 100 from the surface of the well. The main body 102 includes a locking mechanism 108 (also referred herein as an actuating mechanism or actuator assembly) for actuating the kick over action of the kick over tool 100. The lift arm 104 is hinged to the main body 102 and may be moved between a locked, straight position and a kicked over position. The lift arm 104 includes a kick over assembly 110 to kick the lift arm 104 from the straight position to the kicked over position. The adapter 106 is hinged to the lift arm 104 and may be connected to a running tool to install a flow control device (e.g., a gas lift valve) into the side pocket mandrel and connected to a pulling tool to remove a flow control device from the side pocket mandrel.

In one embodiment, the kick over tool 100 may further include a catcher barrel 112 fastened to the main body 102 utilizing a fastener 114, such as a lock nut. The catcher barrel 112 (or catcher member) includes an elongated body portion 116 and basket 118 disposed at a terminal portion of the elongated body portion 116. The basket 118 may be utilized to catch a device which has fallen off the pulling tool or running tool attached to the kick over tool 100. The elongated body portion 116 may provide a surface from which the kick over assembly 110 kicks to move the lift arm 104 to the kicked over position.

The main body 102 includes fishing head, (or neck) 120 for connecting to a conveyance member, such as a wire line (not shown). A latch tool (not shown) may be disposed at a terminal end of the wire line and utilized to latch onto the fishing head 120. The wire line is controlled by equipment located at the surface to lower the kick over tool 100 down the tubing string and to raise the kick over tool 100 to the surface. The main body 102 also includes a spring housing 122 which houses the locking mechanism 108. The locking mechanism 108 comprises a finger latch 124 and a latch housing 126 having a latch rod 128 which is utilized to lock the lift arm 104 in the straight position and to release the lift arm 104 to the kicked over position. The latch housing is disposed like a piston inside the spring housing 122 and is spring loaded against an internal surface of the terminal portion of the spring housing 122 by a first compression spring 130. The latch rod 128, being a part of the latch housing 122, extends axially through a terminal portion of the spring housing 122, and the terminal portion of the latch rod 128 includes a blocking surface 132 which locks the lift arm 104 in the straight position and a release notch (or hole) 134 which releases the lift arm 104 to the kicked over position.

The finger latch 124 may comprise a plate-like polygonal structure and is hinged to a finger latch rod 136 which is disposed within a cylindrical hole 138 in the latch housing 126. The finger latch rod 136 is spring loaded against the latch housing 126 utilizing a second compression spring 140. In one embodiment, the second compression spring 140 is stronger (i.e., requiring more force to compress) than the first compression spring 130. The finger latch 124 includes a catch surface 142 and a one or more sliding surfaces 144. The catch surface 142 may be spring biased (e.g., utilizing a leaf spring 146 attached to the finger latch 124) to extend partially outside the spring housing 122 through a slot 148. During a kick over operation, the catch surface 142 engages an alignment sleeve in a side pocket mandrel to push the latch rod 128 to release the lift arm 104. The sliding surfaces 144 facilitate retraction of the finger latch 124 into the spring housing 122 during withdrawal of the kick over tool 100 from the side pocket mandrel. The slot 148 includes a retraction sliding surface 149 which works in conjunction with the one or more sliding surfaces 144 of the finger latch 124 to facilitate retraction of the finger latch 124 as the kick over tool is raised from down hole.

Optionally, a spacer pad 150 may be attached to the main body 102 to accommodate the kick over tool 100 for different tubing sizes. A plurality of fasteners 152 (e.g., screws, bolts, etc.) and retainer rings 154 may be utilized to attach the spacer pad 150 to the spring housing 122 on an opposite side of the finger latch 124.

The lift arm 104 is hinged or pivotally connected to the main body 102 utilizing a fastener such as a hinge pin 156. At this junction, the lift arm 104 includes a head kick arm 158 which engages the blocking surface 132 of the latch rod 128 to lock the lift arm 104 in the straight position. To release the lift arm 104 to the kicked over position, the lift arm 104 is pulled, along with the main body 102, by wire line, while the latch rod 128 is held stationary by the engagement of the finger latch 124 to a side pocket mandrel stop (e.g., the end of an alignment slot of an alignment sleeve disposed in the mandrel), allowing the head kick arm 158 to slide off the blocking surface 132 and into the release notch/hole 134. In one embodiment, the head kick arm 158 is disposed on a head kick arm plate 160 which is secured or attached to the lift arm 104 utilizing fasteners.

Figure 10:
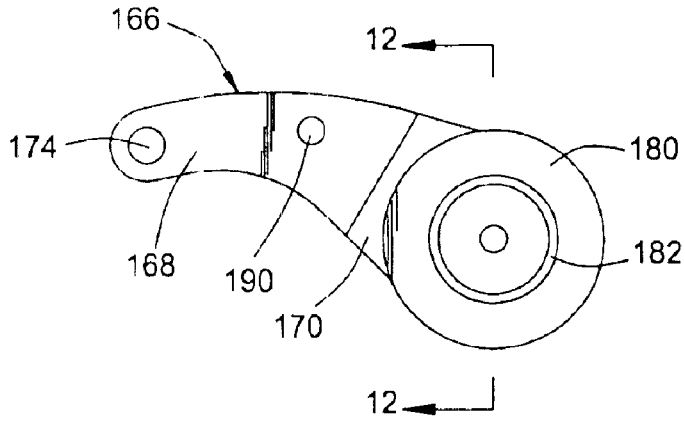
FIG. 10 is a side view of one embodiment of a kick assembly.
Figure 12:
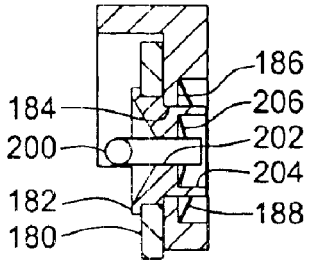
FIG. 12 is a cross sectional view (as indicated by line 12—12 FIG. 10) of one embodiment of a kick assembly.

The lift arm 104 includes a kick over assembly 110 which comprises a kick member 162 (also referred herein as a kick assembly 162) and a biasing member 164. In one embodiment, the biasing member 164 is an extension spring. The kick assembly 162 includes a kick arm 166 pivotally connected to a body portion of the lift arm 104. FIG. 10 is a side view of one embodiment of a kick assembly 162. FIG. 12 is a cross sectional view (viewed as indicated line 12—12 in FIG. 10) of one embodiment of a kick assembly 162. Referring to FIGS. 3, 10 and 12, the kick arm 166 generally comprises a curvilinear tear-drop shaped lever arm having a handle portion 168 and a kick portion 170. The handle portion 168 is pivotally connected to the lift arm 104 utilizing a fastener 172 through a hole 174 located at the handle portion 168. In one embodiment, the fastener 172 comprises a kick arm pin (not shown) and a cotter pin (not shown). The kick arm pin extends from the body portion of th lift arm 104 through the hole 174 and the cotter pin is inserted through a hole through the kick arm pin to secure the kick arm 166 in place. A wheel 180 on a wheel shaft 182 is connected through a recessed hole 184 in the kick portion 170 of the kick arm 166. The wheel 180 provides a rotatable surface which facilitates the kick over action of the kick assembly 162. The wheel shaft 182 is secured against a fringe 186 of the recessed hole 184 utilizing a fastener 188, such as a push-on retainer. Alternatively, the wheel shaft 182 may be welded to the fringe 186 of the recessed hole 184. To limit the angular movement of the kick arm 166, the kick arm 166 may include a restriction pin 190 which is disposed in corresponding relation to a restriction slot 192 on the body of the lift arm 104. The length of the restriction slot 192 may be selected to define a desired range of travel of the kick arm 166 between a retracted position to a protruding position.

A first end 194 of the biasing member 164 may be shaped as a hook or an eyelet and connected to the body portion of the lift arm 104 utilizing a spring retainer 196 and a roll pin 198. A second end 200 of the biasing member 164 is connected to the kick portion 170 of the kick arm 166. In one embodiment, the second end 200 of the biasing member 164 is connected axially through the wheel shaft 182 through a recessed hole 202 and secured against a fringe 204 utilizing a hex lock nut 206.

As shown in FIG. 3, the kick assembly 162 is in the retracted position, and the biasing member 164 is in a stretched position and ready to contract. When the locking mechanism 108 releases the lift arm 104 from the locked straight position and activates the kick over assembly 110, the biasing member 164 provides sufficient contraction force to rotate the kick assembly 162 with flow controls attached from a retracted position to a protruding position.

Figure 11:
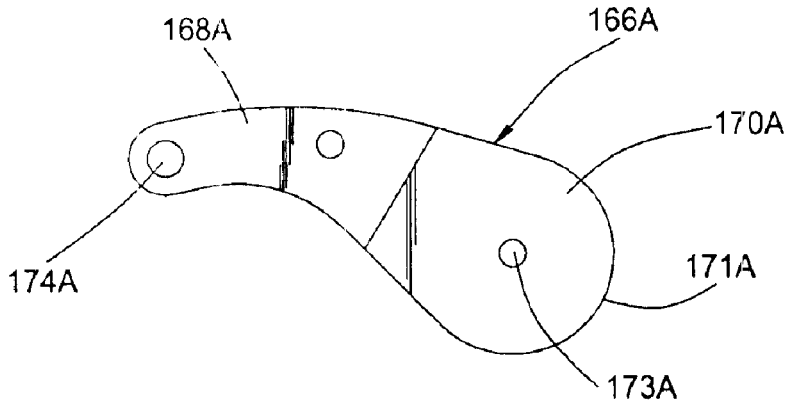
FIG. 11 is a side view of another embodiment of a kick arm.

FIG. 11 is a side view of another embodiment of a kick arm 166A. The kick arm 166A generally comprises a curvilinear tear-drop shaped lever arm having a handle portion 168A and a kick portion 170A. The handle portion 168A is pivotally connected to the lift arm 104 utilizing a fastener through a hole 174A. The kick portion 170A includes a generally rounded edge 171A to provide a smooth surface which facilitates the kick over action of the kick arm 166A. The second end 200 of the biasing member 164 may be attached to a spring retainer 173A (or a hole) disposed centrally in the kick portion 170A.

The adapter 106 is hinged or pivotally connected to the lift arm 104 utilizing a fastener such as a hinge pin 208. The adapter 106 provides the connection for a running tool, pulling tool, and other tools that may be fitted onto the kick over tool 100. In one embodiment, the adapter arm includes a threaded receptacle 210 onto which a tool (e.g., running tool or pulling tool) can be screwed or secured. A running tool is attached to the adapter 106 to install a device (e.g., a gas lift valve) into a side pocket mandrel, and a pulling tool is attached to the adapter 106 to remove a device from a side pocket mandrel. A shear pin 212 is disposed through the adapter 106 and the lift arm 104 to maintain the kick over angle of the kick over tool 100 until it is desirable for the shear pin 212 to be broken to facilitate the procedure being performed by the kick over tool 100. When installing a device into a side pocket, the shear pin 212 maintains the adapter 106 and the attached running tool and device in the aligned kicked over position until the device has been inserted at least partially into the side pocket. When removing a device from a side pocket, the shear pin 212 maintains the adapter 106 and the attached pulling tool in the aligned kicked over position until the pulling tool has been at least partially attached to a latch on the device. The procedures for installation and removal of devices utilizing the kick over tool 100 are described below with respect to FIGS. 4–9.

Figure 4A:
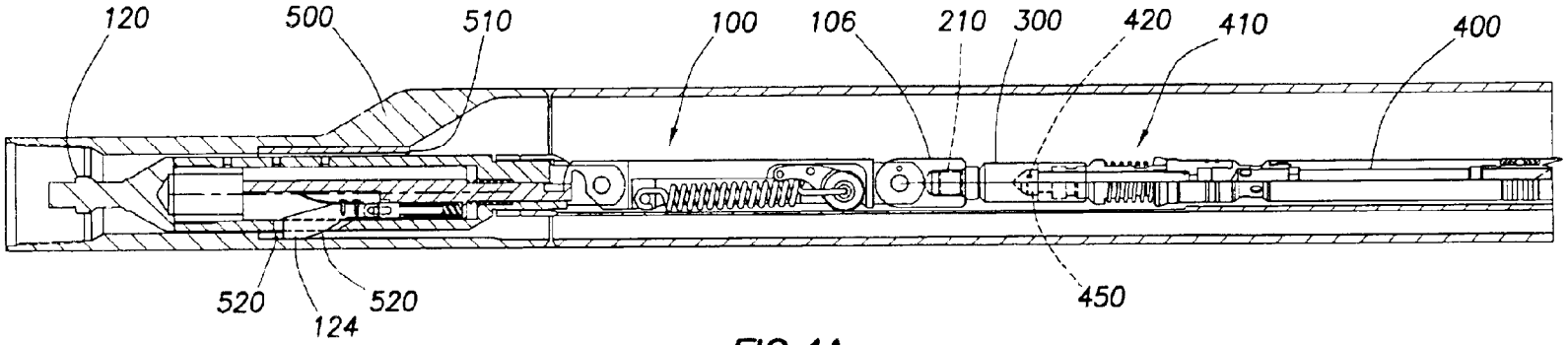
FIGS. 4–6 are sectional views of one embodiment of a kick over tool illustrating a sequence for installing a device into a side pocket mandrel.
Figure 4B:
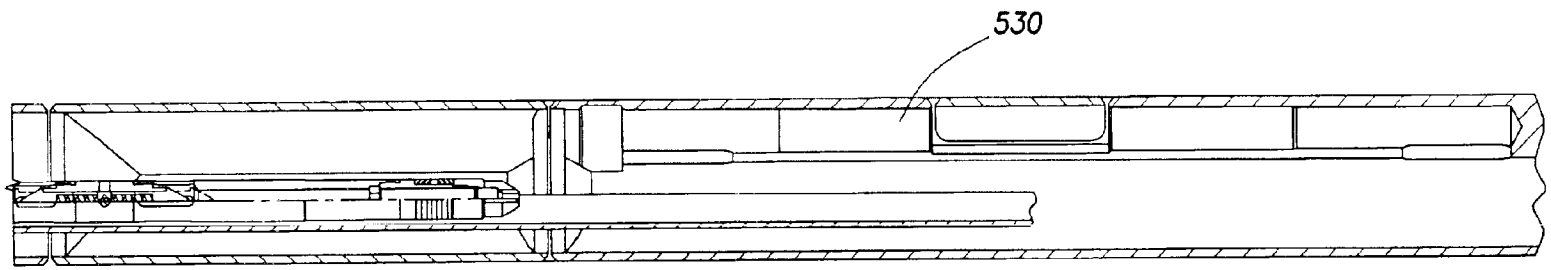
Figure 5A:
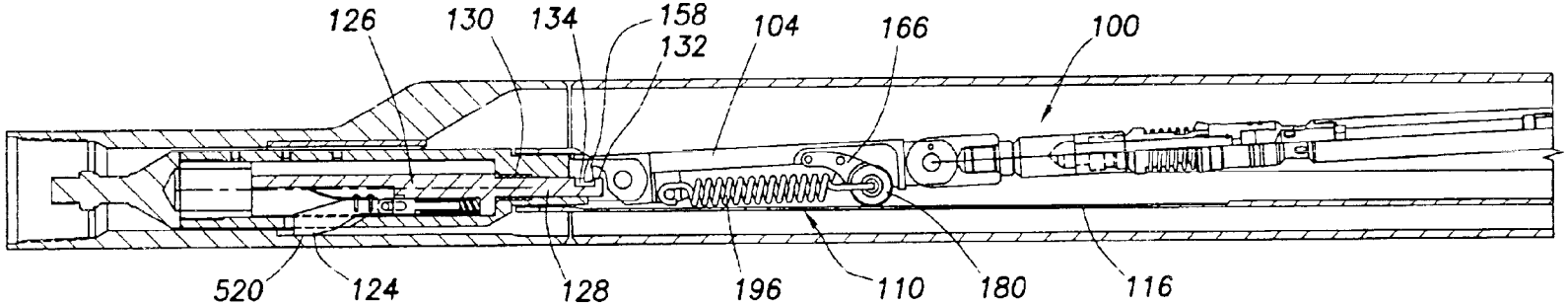
Figure 5B:
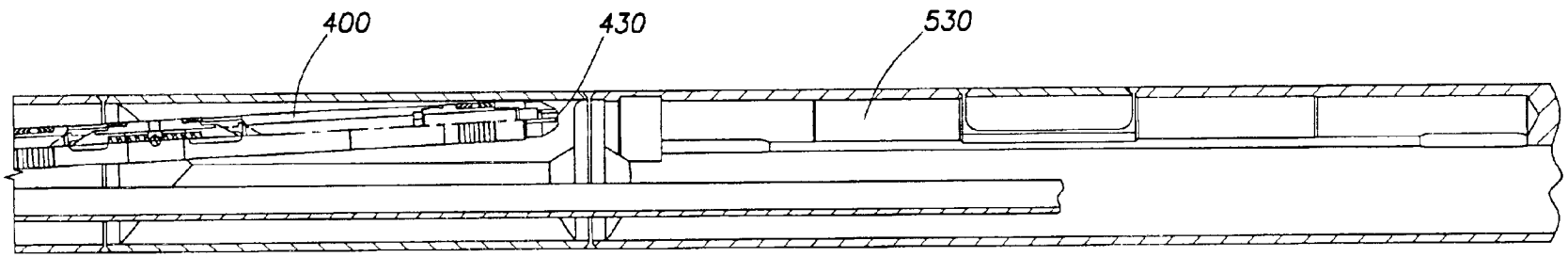
Figure 6A:
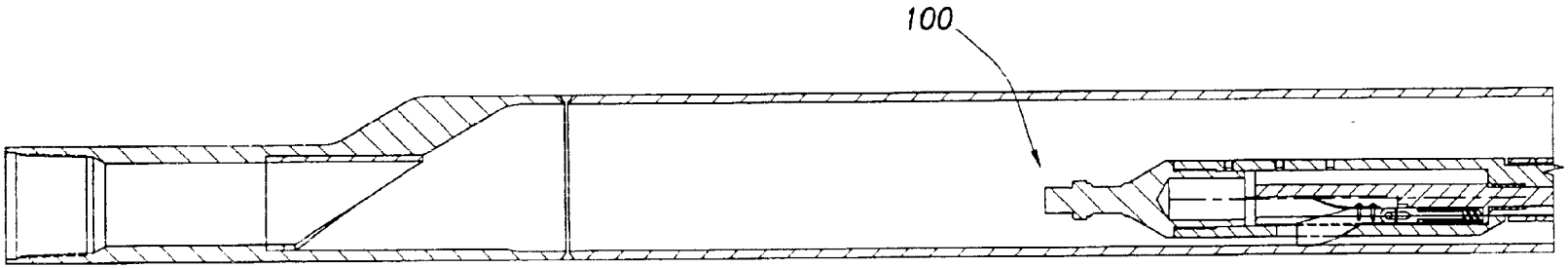
Figure 6B:
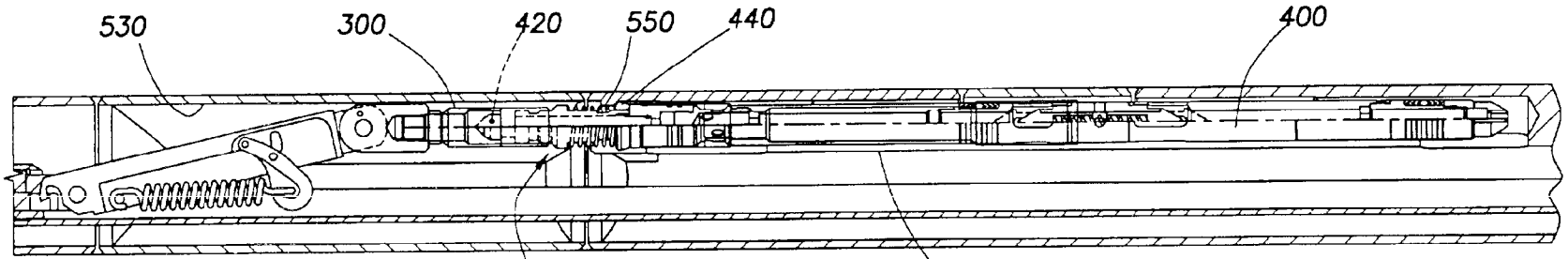

FIGS. 4–6 are cross sectional views of one embodiment of a kick over tool 100 illustrating a sequence for installing a device into a side pocket mandrel. In one embodiment, the kick over tool 100 is utilized with a running tool 300 to install a gas lift valve 400 into a side pocket mandrel 500 of a tubing string. The running tool 300 is screwed or secured onto the threaded receptacle 210 of the adapter 106. The gas lift valve 400 is screwed or securely attached to a device latch 410, which is releasably attached to the running tool 300, for example, utilizing one or more shear pins 420 disposed through the running tool 300 and located to capture a first fishing neck 450 of the device latch 410. The shear pins 420 are sheared (e.g., utilizing jarring action) after the gas lift valve 400 has been installed into the side pocket. The kick over tool 100 is attached to a wire line (not shown) utilizing a connecting tool (not shown) connected to the fishing head 120. The wire line is controlled by surface equipment to move (e.g., lower or raise) the kick over tool 100 within the tubing string.

To begin the valve installation sequence, the kick over tool 100, with the running tool 300 and the gas lift valve 400 attached thereon, is moved (or lowered) down hole until the finger latch 124 of the kick over tool 100 has moved past the alignment sleeve 510 of the side pocket mandrel 500. The kick over tool 100 is then pulled back (e.g., raised) by the wire line to align the kick over tool in the desired orientation since the kick over tool 100 is lower down hole without any specific orientation. As the kick over tool 100 is pulled back, the finger latch 124 is urged by the alignment sleeve 510 into the alignment slot 520, and the kick over tool 100 is aligned to the desired orientation within the side pocket mandrel 500 to kick toward the side pocket 530. As shown in FIG. 4, the kick over tool 100 is aligned in the desired orientation, and the finger latch 124 is in position to engage the end of the alignment slot 520.

To activate the actuating mechanism (i.e., to release the lift arm 104 from the locked, straight position), the kick over tool 100 is pulled back further by the wire line such that the finger latch 124 pushes against the end of the alignment slot 520, causing the latch housing 126 to move and compress the first compression spring 130. At the same time, the latch rod 128 is also moved to release the head kick arm 158 from engagement with the blocking surface 132 and into the release notch 134. As the head kick arm 158 is released from the blocking surface 132 (i.e., lift arm 104 is unlocked), the kick over assembly 110 kicks the lift arm 104 into the kicked over position. To accomplish the kick over action, the extension spring 196 contracts and pulls the kick arm 166 into the protruding position, and because the wheel 180 is pushing against the interior surface of the elongated body portion 116 of the catcher barrel, the lift arm 104 is pushed out into the kicked over position.

As shown in FIG. 5, the lift arm 104 is held in the kicked over position by the kick over assembly 110, and the head kick arm 158 is inserted into the release notch 134. In the kicked over position, the tip 430 of the gas lift valve 400 is positioned at the discriminator area 540 of the side pocket 530, and the gas lift valve 400 is ready to be inserted into the side pocket 530. The kick over tool 100 is moved (e.g., lowered) by the wire line to insert the gas lift valve 400 into the side pocket 530. As the gas lift valve 400 is moved into the side pocket 530, the shear pin 212 is broken by the bending forces exerted thereon. With the shear pin 212 broken, the gas lift valve 400 becomes capable of entering the side pocket 530 in a substantially co-axial or parallel manner. The gas lift valve 400 is continually pushed into the side pocket 530 until a spring loaded latch ring 440 dispose on the device latch 410 is moved past a retaining bump 550 disposed on an interior surface of the side pocket 530. At this position, as shown in FIG. 6, the gas lift valve 400 is retained or secured in the side pocket 530.

To retrieve the kick over tool 100 after the gas lift valve has been installed, the running tool 300 is first separated from the device latch 410 utilizing a series of jarring action (e.g., with a weight bar) performed at the surface and transferred down the wire line to shear the shear pin 420 attaching the running tool 300 to the device latch 410. Once the running tool 300 has been separated from the device latch 410, the kick over tool can be pulled up to the surface by the wire line.

Figure 7A:
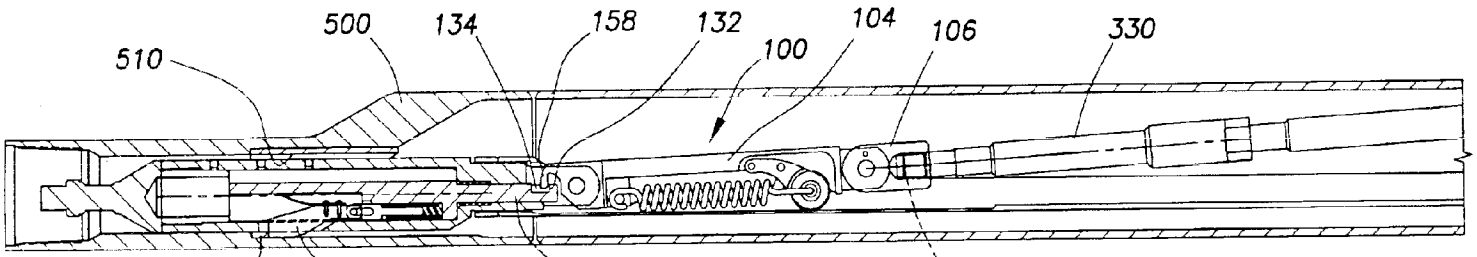
FIGS. 7–9 are sectional views of one embodiment of a kick over tool illustrating a sequence for removing a device from a side pocket mandrel.
Figure 7B:
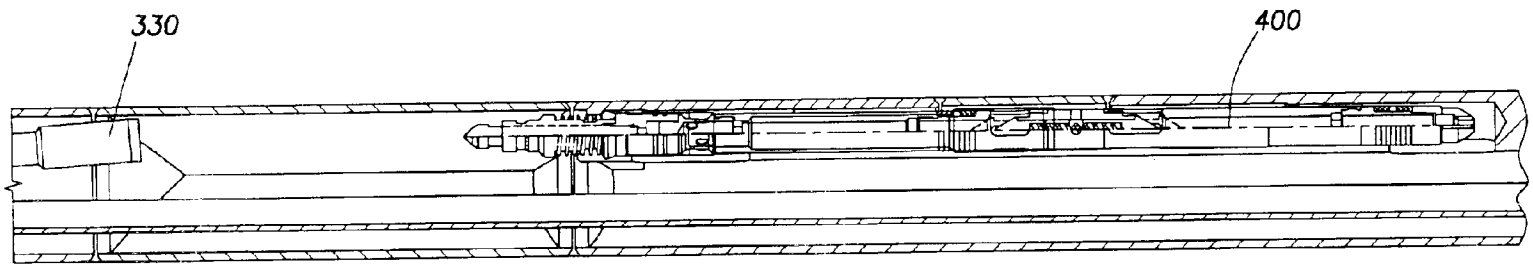
Figure 8A:
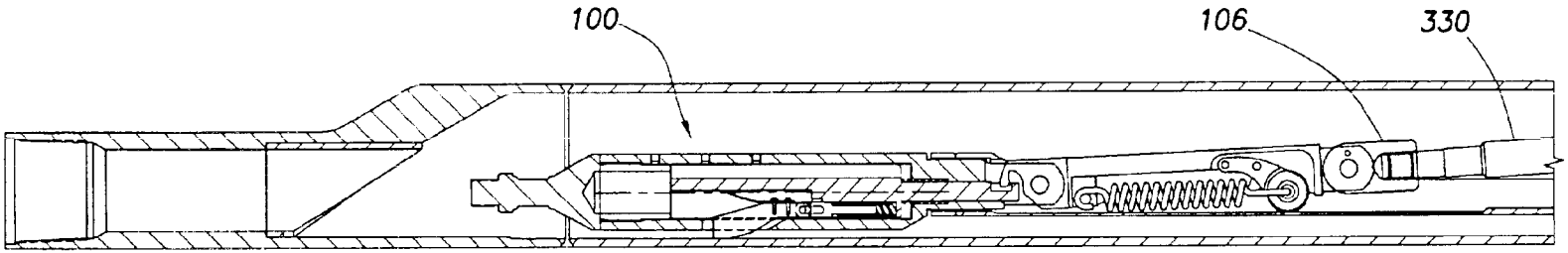
Figure 8B:
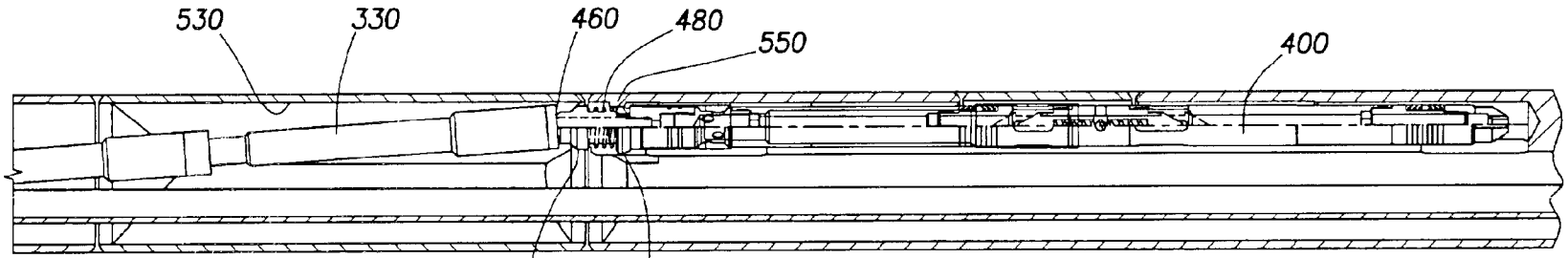
Figure 9A:
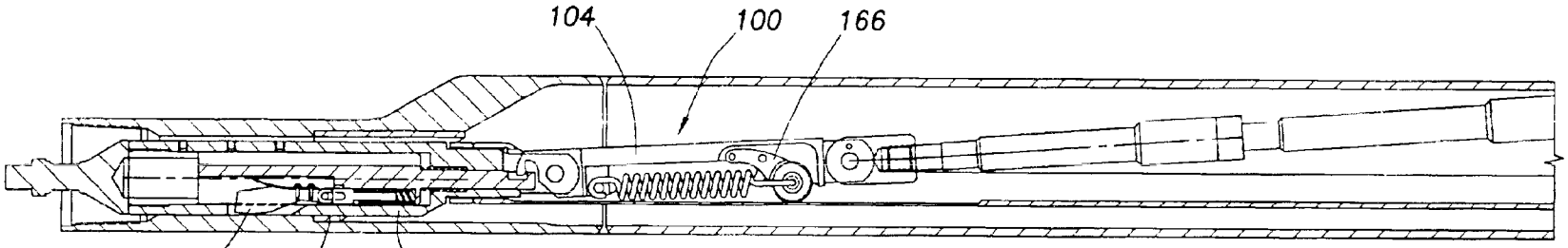
Figure 9B:
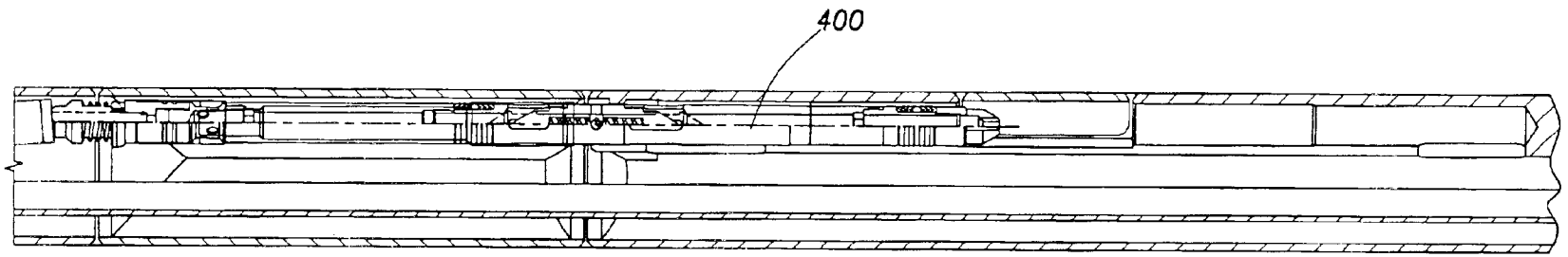

FIGS. 7–9 are cross sectional views of one embodiment of a kick over tool illustrating a sequence for removing a device from a side pocket mandrel. To retrieve a device (e.g., gas lift valve 400) installed in a side pocket mandrel 500, the kick over tool 100 is fitted with a pulling tool 330, which is screwed or secured onto the threaded receptacle 210 of the adapter 106. The kick over tool 100 is lowered down hole into the side pocket mandrel 500 having the gas lift valve 400 installed therein. Similar to the kick over activation of the device installation sequence, the kick over tool 100 is pulled up to align the kick over tool in the proper orientation utilizing the finger latch 124 and the alignment sleeve 510, and then the finger latch 124 engages the end of the alignment slot 520 to push the latch rod 128, releasing the head kick arm 158 of the lift arm 104 from the blocking surface 132 of the latch rod 128. With the head kick arm 158 released, the kick over assembly 110 pushes the lift arm 104 and the adapter 106 with the pulling tool 330 to the kicked over position, as shown in FIG. 7.

The kick over tool 100 is then lowered to move the tip of the pulling tool 330 toward the device latch 410 attached to the gas lift valve 400. The pulling tool 330 engages the device latch 410 and locks onto a second fishing neck 460 disposed on the device latch 410. A series of jarring action is then applied through the wire line to break a shearing pin (not shown) disposed to hold the second fishing neck 460 in place on the device latch 410. Once the shearing pin has been broken, the kick over tool 100 is pulled up by the wire line. The second fishing neck 460 and a compression spring 480 attached thereon are also pulled, the movement of which releases the spring loaded latch ring 440 from engagement with the retaining bump 550 on the interior surface of the side pocket 530. As shown in FIG. 8, the pulling tool 330 is latched onto the second fishing neck 460, with the spring loaded latch ring 440 released from engagement with the retaining bump 550, and the gas lift valve 400 is ready to be retrieved from the side pocket 530.

The kick over tool 100 is then pulled by the wire line to bring the gas lift valve 400 to the surface. As the kick over tool is pulled up from down hole, the finger latch 124 retracts into the spring hosing 122 (shown in FIG. 9) after engaging the end of the alignment slot 520. As the kick over tool 100 is pulled up/out from down hole, the kick arm 166 and the lift arm 104 retract to fit into the tubing string and facilitate retrieval of the kick over tool 100.

While the foregoing is directed to embodiments of the present invention, other and further embodiments of the invention may be devised without departing from the basic scope thereof, and the scope thereof is determined by the claims that follow.

What is claimed is:

1. An apparatus for manipulating an eccentrically located device, comprising:

a main body attachable to a conveyance member;

an arm hinged to the main body;

a lock assembly for selectively retaining the arm in a locked position and releasing the arm from the locked position;

a kick over assembly for moving the arm to a kicked over position, the kick over assembly comprising:

a kick member pivotally connected to a biasing member at a first end and pivotally connected to the arm at a second end; and an adapter connected to the arm, the adapter connectable with a tool for latching onto the device.

2. The apparatus of claim 1, wherein the kick member includes a handle portion connected to the arm and a kick portion rotatable to a protruding position.

3. The apparatus of claim 2, wherein the kick member further comprises a restriction pin disposed correspondingly to a restriction slot on the arm.

4. The apparatus of claim 2, wherein the kick over assembly further comprises a wheel attached to the kick portion of the kick member.

5. The apparatus of claim 4, wherein the second end of the biasing member is connected through the wheel.

6. The method of claim 1, wherein the biasing member comprises an extension spring disposed in a stretched state between the arm and the kick member.

7. The apparatus of claim 1, wherein the lock assembly comprises:

a finger latch disposed to contact an alignment sleeve of a side pocket mandrel; and a latch rod having a blocking surface and a release notch engageable with the arm, the latch rod disposed in moveable relationship with the finger latch.

8. The apparatus of claim 1, further comprising a shear pin disposed through the adapter and the arm.

9. The apparatus of claim 1, further comprising a catcher member connected to the main body.

10. A kick over assembly for a lift arm of a kick over tool, comprising:

a kick member having a first end pivotally connectable to the lift arm and a second end pivotally connectable to an end of a biasing member, wherein the biasing member includes another end connectable to the lift arm.

11. The kick over assembly of claim 10, wherein the kick member comprises a kick arm having a handle portion connectable to the lift arm and a kick portion rotatable between a retracted position and a protruding position.

12. The kick over assembly of claim 11, wherein the kick arm further comprises a restriction pin disposed correspondingly to a restriction slot on the lift arm.

13. The kick over assembly of claim 11, wherein the kick member further comprises a wheel attached to the kick portion of the kick arm.

14. The kick over assembly of claim 13, wherein the second end of the biasing member is co-axially connected through the wheel.

15. The kick over assembly of claim 10, wherein the biasing member comprises an extension spring disposed in a stretched state between the lift arm and the kick member.

16. A kick over tool, comprising:

a main body comprising a fishing head;

an arm hinged to the main body;

a locking mechanism disposed on the main body for locking the arm in a first position and releasing the arm to a kicked over position;

a kick member pivotally connectable to a biasing member at a first end and pivotally connectable to the arm at a second end; and an adapter connected to the arm for latching onto a down hole device.

17. The kick over tool of claim 16, wherein the kick member comprises a restriction pin disposed correspondingly to a restriction slot on the arm for restricting a rotational movement of the kick arm.

18. The kick over tool of claim 16, wherein the kick member comprises a kick arm and a wheel connected to the kick arm.

19. The kick over tool of claim 18, wherein the second end of the biasing member is connected through the wheel.

20. The kick over tool of claim 16, further comprising a shear pin disposed through the adapter and the arm.

21. The kick over tool of claim 16, further comprising a catcher member connected to the main body.

22. A kick over tool for use in a wellbore, comprising:

a main body attachable to a conveyance member;

an arm movable between a retracted position and an extended position, the arm having an adapter at a lower end thereof for latching on to a tool; and a kick member pivotally connected to a biasing member at a first end and pivotally connected to the arm at a second end.

* * * * *